US008690484B2

(12) United States Patent
Oldsen et al.

(10) Patent No.: US 8,690,484 B2
(45) Date of Patent: Apr. 8, 2014

(54) SHEATHED CABLE

(75) Inventors: John G. Oldsen, Butler, PA (US); Dakota Faulkner, Pittsburgh, PA (US)

(73) Assignee: FCI Holdings Delaware, Inc., Wilmington, DE (US)

( * ) Notice: Subject to any disclaimer, the term of this patent is extended or adjusted under 35 U.S.C. 154(b) by 282 days.

(21) Appl. No.: 13/127,588

(22) PCT Filed: Nov. 24, 2008

(86) PCT No.: PCT/US2008/084505

§ 371 (c)(1), (2), (4) Date: May 4, 2011

(87) PCT Pub. No.: WO2010/059168

PCT Pub. Date: May 27, 2010

(65) Prior Publication Data

US 2011/0217126 A1 Sep. 8, 2011

(51) Int. Cl.
*E21D 20/00* (2006.01)
*E21D 20/02* (2006.01)

(52) U.S. Cl.
USPC ..... 405/259.4; 405/259.1; 405/259.2; 405/259.5; 405/259.6; 405/302.2; 411/82; 411/82.1

(58) Field of Classification Search
USPC ..... 405/259.1–259.6, 302.2; 411/82, 82.1; 52/155, 159
See application file for complete search history.

(56) References Cited

U.S. PATENT DOCUMENTS

| | | | | |
|---|---|---|---|---|
| 3,379,019 | A * | 4/1968 | Williams | 405/259.3 |
| 4,850,746 | A | 7/1989 | Finsterwalder et al. | |
| 5,525,013 | A | 6/1996 | Seegmiller et al. | |
| 5,636,945 | A | 6/1997 | Nes | |
| 5,919,006 | A | 7/1999 | Calandra, Jr. et al. | |
| 6,375,271 | B1 | 4/2002 | Young, III | |
| 6,428,243 | B1 | 8/2002 | Hutchins | |
| 7,037,046 | B2 | 5/2006 | Fergusson | |
| 7,381,013 | B1 | 6/2008 | Rataj et al. | |

* cited by examiner

*Primary Examiner* — John Kreck
*Assistant Examiner* — Carib Oquendo
(74) *Attorney, Agent, or Firm* — The Webb Law Firm

(57) ABSTRACT

A cable bolt comprising a tension member having a first end and a second end. A rotatable collar is positioned on the tension member and is rotatable relative to the tension member. An elongate sheath, having a first end and a second end, is disposed over at least a portion of the tension member and secured to the rotatable collar. A method of securing an anchor in a structure is also disclosed.

24 Claims, 7 Drawing Sheets

SHEATHED CABLE

BACKGROUND OF THE INVENTION

1. Field of the Invention

The present invention relates to bolts for rock strata reinforcement and, more particularly, to sheathed cable bolts that are anchored prior to tensioning, tensioned, and post-grouted with a cementitious material.

2. Description of Related Art

Roof and wall support in mining and tunneling operations reinforce rock strata in the roof and walls to prevent the possibility of a collapse. Rock bolts, including solid rigid shaft bolts and flexible cable bolts, are commonly used to consolidate the rock strata. In one form, a rock bolt is point anchored in the blind end of a bore hole, tensioned, and then grouted. The rock bolt may be point anchored by locating a resin cartridge in the blind end of the bore and rotating the rock bolt to burst the resin cartridge and mix its contents. The rock bolt may also be point anchored using a mechanical anchor, such as an expansion shell, that expands in the bore to anchor the bolt. Once anchored, the bolt is tensioned and a cementitious grout is inserted into the bore. The rock bolt may also be provided with a sheath or sleeve, which in combination with the post-grouting, provides corrosion protection for the bolt when used in corrosive environments.

U.S. Pat. No. 5,636,945 to Nes discloses a rock bolt having a tube extending over the bolt to form an annular passage. A nut is threaded on the outer end of the bolt and engages a spherical support. An opening of the support is threaded to engage the external threads on the tube. The bolt is anchored by tightening the nut to expand an expansion bushing.

U.S. Pat. No. 4,850,746 to Finsterwalder et al. discloses a rock anchor having an elongated anchor rod laterally enclosed by an axially elongated sheathing tube with slight play so that the tension member can extend independently of the sheathing tube. An anchor nut is threaded onto the trailing end of the rod to engage a flange of the sheathing tube positioned adjacent a dish-shaped anchor plate.

U.S. Pat. No. 7,381,013 to Rataj et al. discloses a rock bolt having threaded second end with a nut threadably secured thereon. A sleeve surrounds a portion of the bolt to form an annular passage between the sleeve and the bolt. The nut is disposed within the interior of a cup that extends into a bore hole. An annular flange of the cup is attached to a second end of the sleeve. A first end of the sleeve is provided with a cap that engages the bolt.

U.S. Pat. No. 5,525,013 to Seegmiller et al. discloses a cable bolt having a sleeve element crimped to an upper end of the bolt, a "birdcage" enlarged section, and an epoxy-flow dam element. The dam element includes a split ring having a shoulder with a T-extension that engages a T-slot. In a further embodiment, a cable bolt includes a tubular member surrounding the bolt and secured to the bolt via receiving jaws.

U.S. Pat. No. 7,037,046 to Fergusson discloses a cable bolt having a threaded end fitting at a near end of the bolt that cooperates with a load plate, grout injector, and nut. In a particular embodiment, a plastic tube is disposed over a portion of the bolt for the installation of grout and the far end of the cable bolt includes an expansion anchor to enable installation of the bolt.

SUMMARY OF THE INVENTION

In one embodiment, a cable bolt comprising a tension member having a first end and a second end is provided. A rotatable collar is positioned on the tension member and is rotatable relative to the tension member. An elongate sheath, having a first end and a second end, is disposed over at least a portion of the tension member and secured to the rotatable collar.

In certain embodiments, the cable bolt includes a support member to restrict the axial movement of the elongate sheath. The support member may be a fixed collar secured to the tension member. Further, the rotatable collar may be positioned adjacent to the fixed collar towards the second end of the tension member relative to the fixed collar and a resin compression ring is positioned adjacent the second end of the elongate sheath. The tension member may comprise a cable formed from a plurality of wound strands and the elongate sleeve may have a wall portion defining a plurality of openings. Further, the tension member may include a plurality of deformations extending radially outward. The plurality of deformations may be positioned between the rotatable collar and the second end of the tension member.

A bearing plate, defining a grout tube passageway and foam tube passageway therethrough, is positioned adjacent the first end of the tension member. Further, a barrel and wedge assembly is positioned adjacent the bearing plate towards the first end of the tension member. The barrel and wedge assembly has a plurality of wedges engaged with the tension member and a barrel is disposed over and receives the wedges therein. An end plug is positioned proximate the first end of the elongate sheath. The end plug includes a cylindrical body defining a cable bolt passageway and foam tube passageway therethrough, the cable bolt extending through the cable bolt passageway. A foam injection tube is disposed within at least a portion of the foam tube passageway.

In a further embodiment, a method of securing an anchor in a structure is provided. The method includes the step of providing a cable bolt comprising a tension member having a first end and a second end, and an elongate sheath having a first end and a second end disposed over at least a portion of the tension member. The sheath is rotatable relative to the tension member. The method further includes the step of positioning the second end of the tension member in a bore hole drilled in the structure with the second end of the tension member engaging a capsule having a resin component and a catalyst component. The method includes a further step of rotating the cable bolt relative to the sheath to fracture and/or mix the resin and catalyst components to secure the second end of the tension member in the bore hole.

The cable bolt may include a resin compression ring positioned adjacent the second end of the elongate sheath to substantially prevent resin from flowing towards the first end of the tension member. Further, the cable bolt may include a bearing plate and barrel and wedge assembly, where the barrel and wedge assembly is restricted from axial movement towards the first end of the tension member. The method may include the step of tensioning the cable bolt. Further, the cable bolt may be provided with an end plug as described above and injected with expandable foam into a foam injection tube positioned at least a portion of the way into the foam tube passageway of the end plug such that the expandable foam seals a portion of an annulus between the tension member and the elongate sheath. Grout may then be injected into the elongate sheath to encase at least a portion of the cable bolt in grout. The grout may be a cementitious grout material.

In a particular embodiment, the grout is injected into a grout tube positioned in the grout tube passageway of the end cap. The grout tube extends beyond the foam insertion tube in the annulus between the tension member and the elongate sheath. A wall portion of the elongate sleeve may define a plurality of openings such that the grout flows through the elongate sheath towards the second end of the sheath and flows out the plurality of openings into an annulus between the bore hole and the elongate sheath.

DESCRIPTION OF THE PREFERRED EMBODIMENTS

Figure 1:
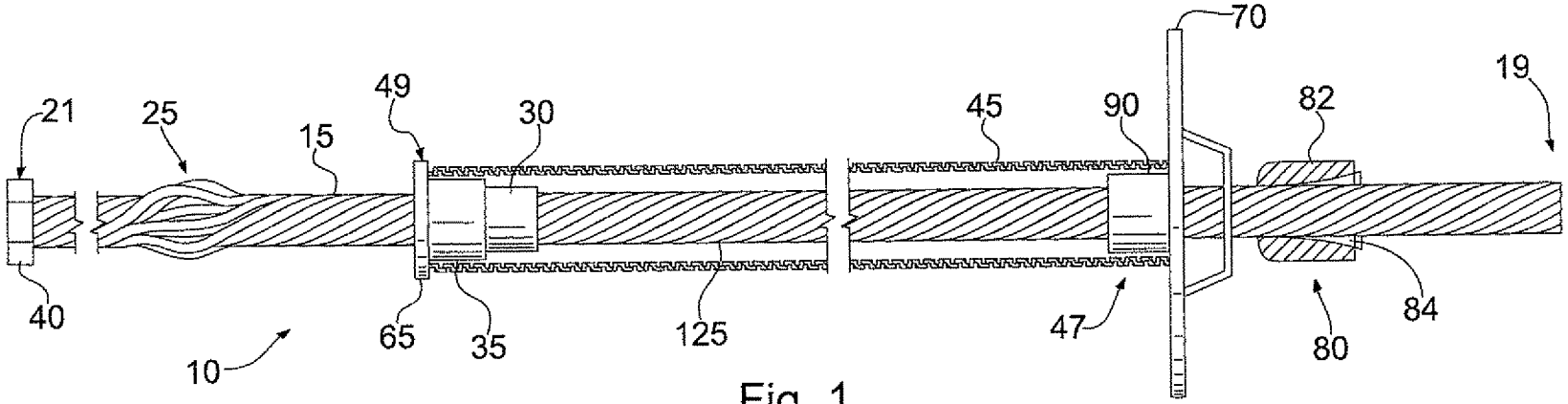
FIG. 1 is a part-sectioned side view of a cable bolt according to one embodiment of the present invention.

The present invention will now be described with reference to the accompanying figures. For purposes of the description hereinafter, the terms "upper", "lower", "right", "left", "vertical", "horizontal", "top", "bottom" and derivatives thereof shall relate to the invention as it is oriented in the drawing figures. However, it is to be understood that the invention may assume various alternative variations and step sequences, except where expressly specified to the contrary. It is to be understood that the specific apparatus illustrated in the attached figures and described in the following specification is simply an exemplary embodiment of the present invention. Hence, specific dimensions and other physical characteristics related to the embodiments disclosed herein are not to be considered as limiting.

Referring to FIGS. 1-4, a cable bolt 10 includes a tension member 15 having a first end 19 and a second end 21. The tension member 15 may be a cable formed from a plurality of wound strands. A support member, such as a fixed collar 30 is fixedly secured to the tension member 15 between the first and second ends 19, 21. A rotatable collar 35 is positioned on the tension member 15. The rotatable collar 35 is rotatable relative to the tension member 15 and is positioned adjacent to the fixed collar 30 towards the second end 21 of the tension member 15 relative to the fixed collar 30. The rotatable collar 35 is free to rotate about the tension member 15. Further, the rotatable collar 35 is free to slide or translate axially along the tension member 15. The axial movement of the rotatable collar 35 is restricted by the fixed collar 30. An elongate sheath 45 having a first end 47 and a second end 49 is disposed over at least a portion of the tension member 15 and is secured to the rotatable collar 35 such that the tension member 15 is free to rotate relative to the sheath 45. The elongate sheath 45 includes a plurality of ribs 52 and plurality of spaced-apart openings 54 extending through the wall of the sheath 45. The openings 54 are axially and circumferentially spaced from one another. The elongate sheath 45 may be formed from plastic, such as high density polyethylene, although other suitable materials may also be used.

Referring to FIGS. 6-9, the fixed collar 30 has a first half 32 and a second half 33 for receiving the tension member 15 therebetween. Each of the halves 32, 33 of the fixed collar 30 includes fastener openings 34 for receiving a fastener (not shown), such as a bolt. The halves 32, 33 are clamped together through the fastener openings 34 to fixedly secure the fixed collar 30 to the tension member 15. The fastener openings 34 in the second half 33 of the fixed collar 30 may be tapped and the openings 34 in the first half 32 may be through holes. The fixed collar 30 may formed from metal, such as steel, although other suitable materials may also be used.

Figure 4:
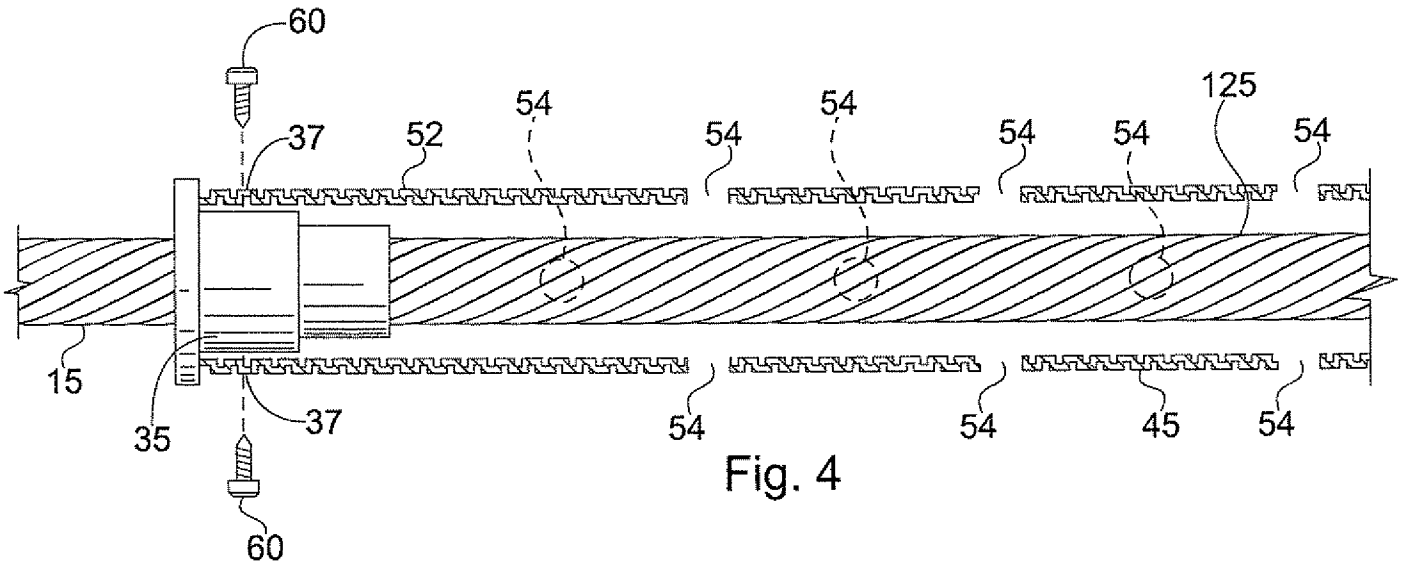
FIG. 4 is a part-sectioned side view of the cable bolt shown in FIG. 1, showing an intermediate portion of the cable bolt.
Figure 5:
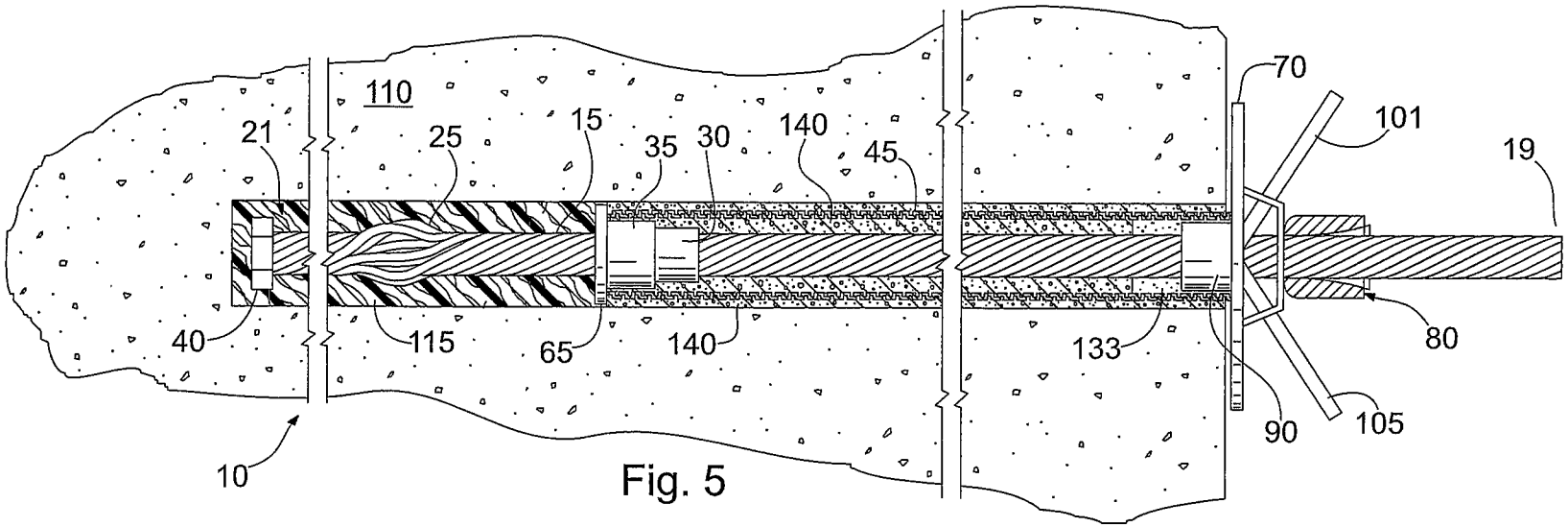
FIG. 5 is a part-sectioned side view of the cable bolt shown in FIG. 1, showing the cable bolt anchored and grouted.
Figure 7:
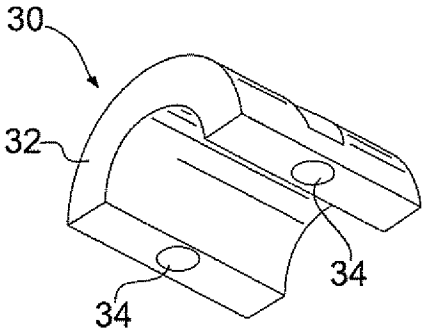
FIG. 7 is a bottom left perspective view of the portion of the fixed collar shown in FIG. 6.
Figure 9:
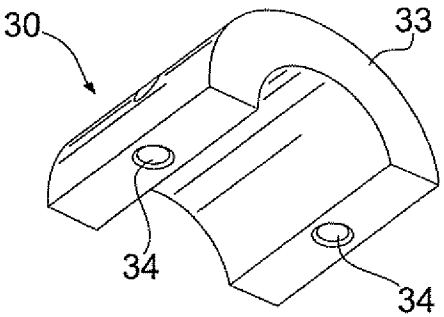
FIG. 9 is a bottom right perspective view of the portion of the fixed collar shown in FIG. 8.
Figure 6:
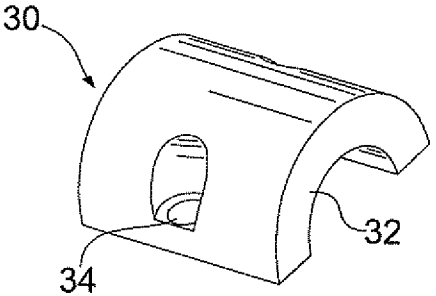
FIG. 6 is a top right perspective view of a portion of a fixed collar according one embodiment of the present invention.
Figure 8:
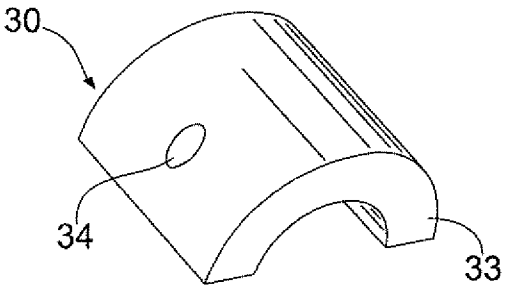
FIG. 8 is a top right perspective view of a further portion of the fixed collar according to one embodiment of the present invention.
Figure 12:
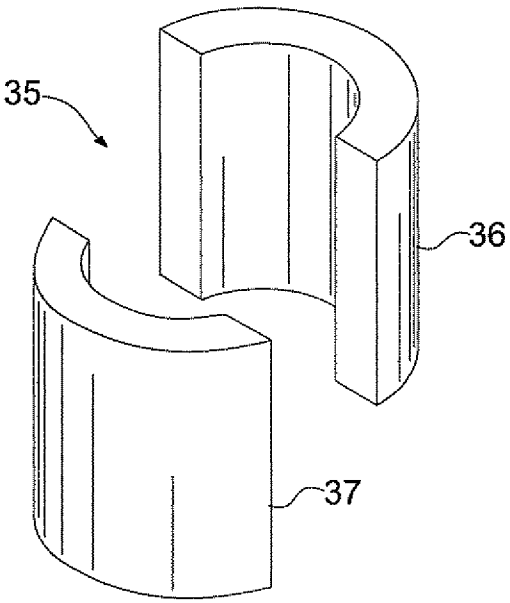
FIG. 12 is an exploded perspective view of a rotatable collar according to one embodiment of the present invention.

Referring to FIG. 12, the rotatable collar 35 has a first half 36 and a second half 37 for receiving the tension member 15 therebetween. The rotatable collar 35 is rotatably secured to the tension member 15 by securing each of the halves 36, 37 to the elongate sheath 45. For instance, as shown in FIG. 4, the second end 49 of the elongate sheath 45 may be secured to each of the halves 36, 37 by providing openings 39 that extend through the sheath 45 into the halves 36, 37 of the rotatable collar 35. A fastener 60 is then inserted through the openings 39 to secure the elongate sheath 45 to the rotatable collar 35. This arrangement allows the rotatable collar 35, and the elongate sheath 45, to rotate independently from the tension member 15. The openings 39 may be provided by drilling a hole into the elongate sheath 45 and the rotatable collar 35. The fastener 60 may be a screw, such as a pan head screw, although other suitable fasteners may be used. The rotatable collar 35 may be formed from plastic, such as polyethylene, although other suitable materials may also be used.

Figure 2:
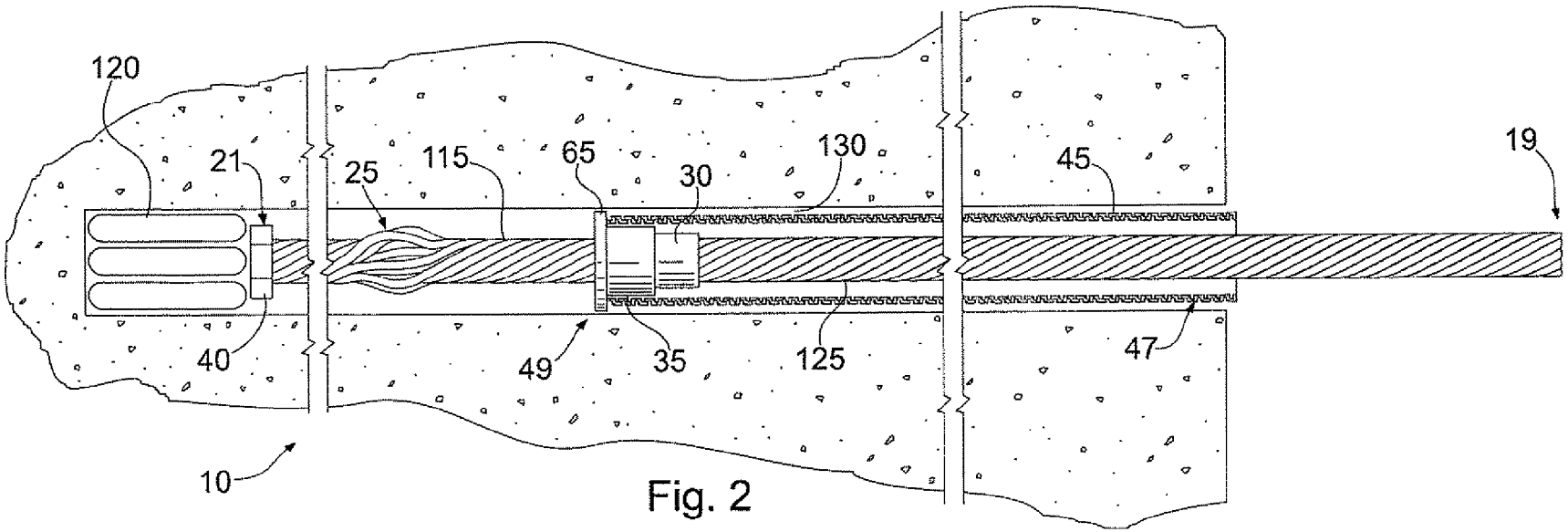
FIG. 2 is a part-sectioned side view of the cable bolt shown in FIG. 1, showing the cable bolt inserted into a bore hole.
Figure 3:
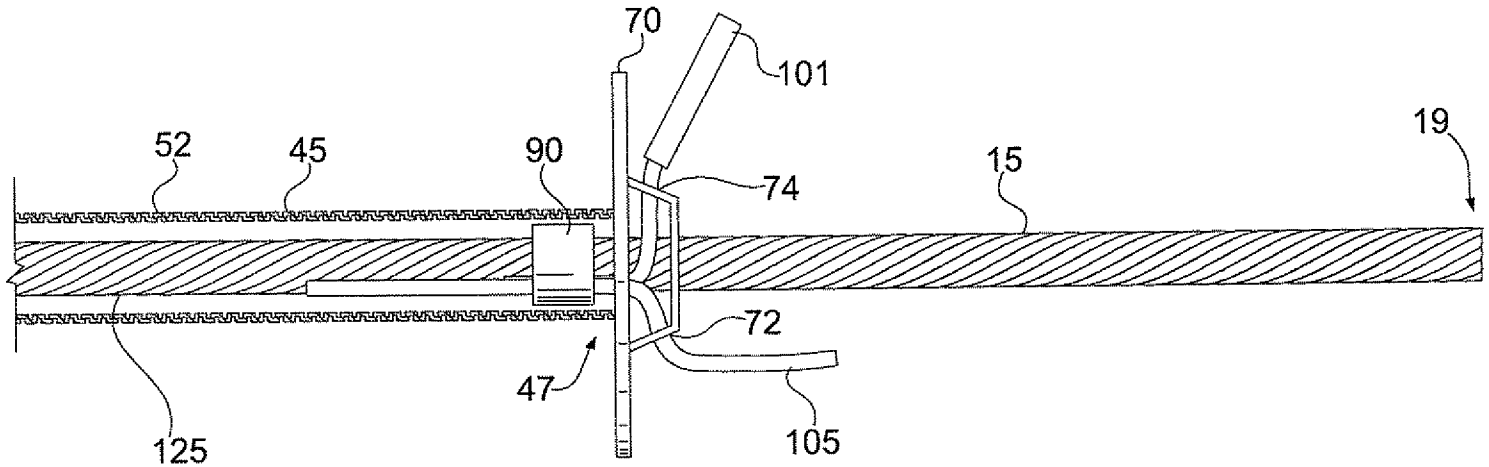
FIG. 3 is a part-sectioned side view of the cable bolt shown in FIG. 1, showing a first end of the cable bolt.

Referring to FIGS. 1-3, the cable bolt 10 further includes a resin compression ring 65 disposed over the tension member 15 and positioned adjacent to the second end 49 of the elongate sheath 45. The cable bolt 10 also includes a bearing plate 70 defining a grout tube passageway 72 and foam tube passageway 74 therethrough. The bearing plate 70 is positioned adjacent the first end 19 of the tension member 15. Further, a barrel and wedge assembly 80 may be provided adjacent the bearing plate 70 towards the first end 19 of the tension member 15. The barrel and wedge assembly 80 has a plurality of wedges 84 engaged with the tension member 15 and a barrel 82 disposed over and receiving the wedges 84 therein. The barrel and wedge assembly 80 is restricted from axial movement towards the first end 19 of the tension member 15.

Figure 10:
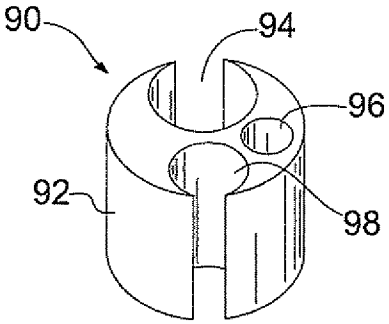
FIG. 10 is a perspective view of an end cap according to one embodiment of the present invention.
Figure 11:
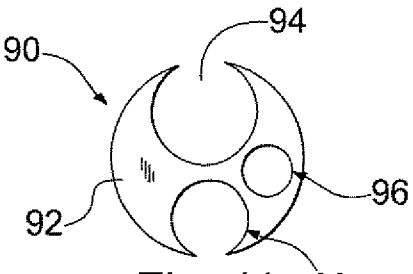
FIG. 11 is a top view of the end cap shown in FIG. 10.

Referring to FIGS. 1-3, the cable bolt 10 includes an end plug 90 proximate the first end 47 of the elongate sheath 45. The end plug 90, as shown in FIGS. 10 and 11, has a cylindrical body 92 defining a cable bolt passageway 94, a foam tube passageway 96, and a grout tube passageway 98 therethrough. The end plug 90 is positioned over the tension member 15 through the cable bolt passageway 94 and into or near the first end 47 of the sheath 45. A foam injection tube 101 is threaded through the foam tube passageway 74 of the bearing plate 70 and through the foam tube passageway 96 of the end plug 90 into the sheath 45. A grout tube 105 is threaded through the grout tube passageway 72 of the bearing plate 70 and through the grout tube passageway 98 of the end plug 90 into the sheath 45. As shown more clearly in FIG. 3, the grout tube 105 extends toward the second end 49 of the sheath 45 beyond the foam injection tube 101.

Referring to FIGS. 1 and 2, the tension member 15 includes at least one deformation 25 extending radially outward from the member 15. The deformation(s) 25 is positioned between the rotatable collar 35 and the second end 21 of the tension member 15. The deformation 25 may be a "bulb" or "cage" formed by the separation of the wound strands of the tension member 15. The tension member 15 may include a plurality of deformations 25. For instance, the tension member 15 may include five deformations 25 positioned towards the second end 21 of the tension member 15. The tension member 15 may also include a button or sleeve 40 at the end of the tension member 15. The deformation 25 and button 40 facilitate the rotational mixing of resin during anchoring of the cable bolt 10.

Referring to FIGS. 1-5, a method of securing an anchor in a structure is disclosed. A structure 110, such as a mine or tunnel roof, is provided with a bore hole 115 drilled into the structure 110. A capsule 120 or a bundle of capsules 120 having a resin component and a catalyst component is pushed to the top of the bore hole 115 using a pushrod or conduit. The capsule 120 may be a polyester resin cartridge. The cable bolt 10 is positioned within the bore hole 115 by placing the second end 21 of the tension member 15 into the bore hole 115 such that the second end 21 of the tension member 15 engages the capsule or capsules 120. The cable bolt 10 is then rotated relative to the elongate sheath 45 to fracture the capsule(s) 120 and mix the resin and catalyst components 135 released therefrom, which cure and harden thereby securing the second end 21 of the tension member 15 in the bore hole 115. The cable bolt 10 may be inserted into the bore hole 115 using a stiffener tube (not shown) that surrounds a portion of the bolt 10 and provides rigidity to assist in the positioning of the bolt 10. The stiffener tube is removed prior to anchoring or securing the second end 21 of the tension member 15. During the fracture and mixing of the capsule 120, the resin compression ring 65, positioned adjacent to the second end 49 of the elongate sheath 45, substantially prevents resin 135 from flowing towards the first end 19 of the tension member 15. Thus, as the cable bolt 10 engages the capsule 120, the resin compression ring 65 forces the resin towards the blind end of the bore hole 115.

After anchoring the second end 21 of the tension member 15, the end plug 90, with the foam injection tube 101 and the grout tube 105 inserted through the respective passages 96, 98, is positioned over the first end 19 of the tension member 15 via the cable bolt passageway 94 of the end plug 90 and into the first end 47 of the elongate sheath 45. The space between the elongate sheath 45 and the tension member 15 forms an annulus 125 surrounding the tension member 15. The space between the bore hole 115 and the elongate sheath 45 forms an annulus 130 surrounding the sheath 45. A portion of the annulus 130 towards the first end of the elongate sheath 45 may be plugged to prevent excessive grout from running out of the annulus 130.

With the end plug 90 in place, the foam injection tube 101 and the grout tube 105 are threaded through the grout tube passageway 72 and the foam tube passageway 74 of the bearing plate 70. The bearing plate 70 is positioned over the first end 19 of the tension member 15 proximate to the structure 110 and bore hole 115. The barrel and wedge assembly 80 is then threaded over the first end 19 of the tension member 15 and positioned adjacent to the bearing plate 70. The cable bolt 10 is then tensioned to a pre-determined load using a hydraulic tensioner (not shown) with tensioner wedges (not shown) to grip and engage the bolt 10. In certain embodiments, the bolt 10 may be tensioned to 24 tons. Once a desired pre-tension is reached, the bearing plate 70 will be engaged with the structure 110 and the barrel and wedge assembly 80 will maintain the tension on the bolt 10.

After tensioning of the bolt 10, expandable foam 133 is injected into the foam injection tube 101 and into the annulus 125 between the elongate sheath 45 and the tension member 15. The foam seals a portion of the annulus 125 towards the first end 47 of the elongate sheath 45. The foam 133 does not extend beyond the end of the grout tube 105. The expandable foam may be expandable polyurethane foam, although other suitable expanding foams may be used. The cable bolt 10 is then grouted by injecting grout 140 into the grout tube 105 to encase at least a portion of the cable bolt 10. As shown more clearly in FIG. 3, the grout tube 105 extends beyond the foam insertion tube 101 in the annulus 125 between the sheath 45 and the tension member 15. The foam 133 injected into the annulus 125 between the elongate sheath 45 and the tension member 15 prevents the grout 140 from flowing out the first end 47 of the elongate sheath 45. Thus, the grout 140 flows through the elongate sheath 45 towards the second end 49 of the sheath 45 and flows out the plurality of openings 54 into the annulus 130 between the bore hole 115 and the sheath 45. The grout 140 is prevented from running out the first end 47 of the sheath 45 by the seal formed by the end plug 90 and foam. As noted above, the annulus 130 between the sheath 45 and the bore hole 115 may also be plugged using a cloth rag or other material to prevent the grout 140 from excessively running out the bottom of the bolt 10. The grout 140 may be a cementitious grout material.

Accordingly, the cable bolt 10 is anchored to provide reinforcement of the structure 110 with the cementitious grout and the elongate sheath 45 providing two layers of corrosion protection. Furthermore, the fixed collar 30 and rotatable collar 35 provide a simple and reliable arrangement for securing the sheath 45 to the tension member 15 while allowing rotation of the tension member 15 relative to the sheath 45. Due to the independent rotation of the elongate sheath 45 relative to the tension member 15, the tension member 15 can be rotated to fracture and mix the resin while the sheath 45 remains stationary ensuring that the sheath 45 is not damaged during anchoring of the bolt 10. In particular, rotation of the elongate sheath 45 within the bore hole 115 may cause abrasion damage to the sheath 45.

It will be readily appreciated by those skilled in the art that modifications may be made to the invention without departing from the concepts disclosed in the foregoing description. Such modifications are to be considered as included within the following claims unless the claims, by their language, expressly state otherwise. Accordingly, the particular embodiments described in detail herein are illustrative only and are not limiting to the scope of the invention which is to be given the full breadth of the appended claims and any and all equivalents thereof.

The invention claimed is:

1. A rock bolt comprising:

a tension member having a first end and a second end;

a rotatable collar positioned on the tension member, the rotatable collar being rotatable relative to the tension member;

an elongate sheath having a first end and a second end, the elongate sheath being disposed over at least a portion of the tension member and secured to the rotatable collar, the elongate sheath being rotatable relative to the tension member;

a bearing plate defining a grout tube passageway therethrough, the bearing plate positioned adjacent the first end of the tension member; and an end plug comprising a cylindrical body defining a tension member passageway and a grout tube passageway therethrough, at least a portion of the end plug is positioned within the elongate sheath and spaced from the rotatable collar, the tension member extending through the tension member passageway.

2. The rock bolt of claim 1, further comprising a support member, the support member restricting axial movement of the elongate sheath.

3. The rock bolt of claim 2, wherein the support member is a fixed collar secured to the tension member, the fixed collar configured to restrict movement of the elongate sheath to a single axial direction.

4. The rock bolt of claim 3, wherein the rotatable collar is positioned adjacent to the fixed collar towards the second end of the tension member relative to the fixed collar, the cable bolt further comprising a resin compression ring positioned adjacent the second end of the elongate sheath.

5. The rock bolt of claim 1, wherein the tension member comprises a cable formed from a plurality of wound strands.

6. The rock bolt of claim 1, wherein the bearing plate defines a foam tube passageway therethrough.

7. The rock bolt of claim 6, further comprising a barrel and wedge assembly positioned adjacent the bearing plate towards the first end of the tension member, the barrel and wedge assembly having a plurality of wedges engaged with the tension member and a barrel disposed over and receiving the wedges therein.

8. The rock bolt of claim 1, wherein a wall portion of the elongate sheath defines a plurality of openings.

9. The rock bolt of claim 1, wherein the end plug is positioned proximate the first end of the elongate sheath, the end plug defining a foam tube passageway therethrough.

10. The rock bolt of claim 9, further comprising a foam injection tube disposed within at least a portion of the foam tube passageway.

11. The rock bolt of claim 1, wherein the tension member further comprises a plurality of deformations extending radially outward, the plurality of deformations beings positioned between the rotatable collar and the second end of the tension member.

12. The rock bolt of claim 1, wherein the rotatable collar is positioned within the elongate sheath.

13. The rock bolt of claim 12, wherein the first end of the elongate sheath is positioned closer to the first end of the tension member than the second end of the elongate sheath, the rotatable collar positioned adjacent to the second end of the elongate sheath.

14. A method of securing an anchor in a structure, comprising the steps of:

providing a rock bolt comprising:

a tension member having a first end and second end, and an elongate sheath having a first end and a second end disposed over at least a portion of the tension member, the sheath being rotatable relative to the tension member;

providing an end plug comprising a cylindrical body, the body defining a tension member passageway and a grout tube passageway therethrough, at least a portion of the end plug is positioned within the elongate sheath the tension member extending throw the tension member passageway;

positioning the second end of the tension member in a bore hole drilled in the structure with the second end of the tension member engaging a capsule having a resin component and a catalyst component; and rotating the cable bolt relative to the sheath to fracture and/or mix the resin and catalyst components to secure the second end of the tension member in the bore hole.

15. The method of claim 14, wherein the cable bolt further comprises a fixed collar secured to the tension member and a rotatable collar secured to the tension member, the rotatable collar positioned adjacent to the fixed collar, the elongate sheath secured to the rotatable collar to provide the rotational movement relative to the tension member.

16. The method of claim 15, wherein the rotatable collar is positioned towards the second end of the tension member relative to the fixed collar, the cable bolt further comprising a resin compression ring positioned adjacent the second end of the elongate sheath, wherein the resin compression ring substantially prevents resin from flowing towards the first end of the tension member.

17. The method of claim 15, wherein the tension member further comprises a plurality of deformations extending radially outward, the plurality of deformations being positioned between the rotatable collar and the second end of the tension member.

18. The method of claim 14, wherein the cable bolt further comprises a bearing plate positioned adjacent the first end of the tension member, the bearing plate defining a grout tube passageway and foam tube passageway therethrough; and a barrel and wedge assembly positioned adjacent the bearing plate towards the first end of the tension member, the barrel and wedge assembly having a plurality of wedges engaged with the tension member and a barrel disposed over and receiving the wedges therein, wherein the barrel and wedge assembly is restricted from axial movement towards the first end of the tension member.

19. The method of claim 18, further comprising the step of tensioning the cable bolt.

20. The method of claim 19, wherein the body of the end plug defines a foam tube passageway therethrough, the method further comprising:

injecting expandable foam into a foam injection tube positioned at least a portion of the way into the foam tube passageway of the end plug such that the expandable foam seals a portion of an annulus between the tension member and the elongate sheath.

21. The method of claim 20, further comprising the step of:

injecting grout into the elongate sheath to encase at least a portion of the cable bolt in grout.

22. The method of claim 21, wherein the grout is a cementitious grout material.

23. A method of securing an anchor in a structure, comprising the steps of:

providing a cable bolt comprising:

a tension member having a first end and second end; and an elongate sheath having a first end and a second end disposed over at least a portion of the tension member the sheath being rotatable relative to the tension member;

positioning the second end of the tension member in a bore hole drilled in the structure with the second end of the tension member engaging a capsule having a resin component and a catalyst component;

rotating the cable bolt relative to the sheath to fracture and/or mix the resin and catalyst components to secure the second end of the tension member in the bore hole;

tensioning the cable bolt;

providing an end plug comprising a cylindrical body, the body defining a cable bolt passageway, a foam tube passageway, and a grout tube passageway therethrough, the end plug positioned over the first end of the tension member through the cable bolt passageway;

injecting expandable foam into a foam injection tube positioned at least a portion of the way into the foam tube passageway of the end plug such that the expandable foam seals a portion of an annulus between the tension member and the elongate sheath;

injecting grout into the elongate sheath to encase at least a portion of the cable bolt in grout;

wherein the cable bolt further comprises a bearing plate positioned adjacent the first end of the tension member, the bearing plate defining a grout tube passageway and foam tube passageway therethrough; and a barrel and wedge assembly positioned adjacent the bearing plate towards the first end of the tension member the barrel and wedge assembly having a plurality of wedges engaged with the tension member and a barrel disposed over and receiving the wedges therein, wherein the barrel and wedge assembly is restricted from axial movement towards the first end of the tension member, wherein the grout is injected into a grout tube positioned in the grout tube passageway of the end plug, the grout tube extending beyond the foam insertion tube in the annulus between the tension member and the elongate sheath.

24. The method of claim 23, wherein a wall portion of the elongate sheath defines a plurality of openings such that the grout flows through the elongate sheath towards the second end of the sheath and flows out the plurality of openings into an annulus between the bore hole and the elongate sheath.

* * * * *